US006824209B1

(12) United States Patent
Redzisz et al.

(10) Patent No.: US 6,824,209 B1
(45) Date of Patent: Nov. 30, 2004

(54) COLLAPSIBLE PORTABLE SEAT CONSTRUCTION

(75) Inventors: Andrezj M. Redzisz, Wheeling, IL (US); Donald E. Godshaw, Evanston, IL (US)

(73) Assignee: Travel Caddy, Inc., DesPlaines, IL (US)

( * ) Notice: Subject to any disclaimer, the term of this patent is extended or adjusted under 35 U.S.C. 154(b) by 0 days.

(21) Appl. No.: 10/438,653

(22) Filed: May 15, 2003

(51) Int. Cl.[7] ..... A47C 4/28

(52) U.S. Cl. ..... 297/45; 297/188.01; 297/183.5

(58) Field of Search ..... 297/45, 42, 188.13, 297/188.01, 183.5, 16.1, 195.11, 195.1; 224/155

(56) References Cited

U.S. PATENT DOCUMENTS 2,909,215 A * 10/1959 Mitchell ..... 297/40
3,122,397 A * 2/1964 Mintz ..... 297/188.13
4,387,924 A * 6/1983 Fernandez ..... 297/188.01
4,544,203 A * 10/1985 Younger et al. ..... 297/391
4,824,167 A * 4/1989 King ..... 297/129
5,186,372 A * 2/1993 Biedenharn, Jr. ..... 224/155
5,544,793 A * 8/1996 Harrop ..... 224/645
5,628,437 A * 5/1997 Kober ..... 224/155
5,927,798 A * 7/1999 Ahn ..... 297/129
6,000,752 A * 12/1999 Shyr ..... 297/188.08
6,375,258 B1 * 4/2002 Fang ..... 297/188.08
6,547,324 B1 * 4/2003 Ammann, Jr. ..... 297/129

* cited by examiner

*Primary Examiner*—Milton Nelson, Jr.
(74) *Attorney, Agent, or Firm*—Banner & Witcoff, Ltd.

(57) ABSTRACT

A portable seat is formed from rectangular frame members that are joined at their midpoints and foldable between an open and a closed position. A flexible seat is attached to the top leg of each of the frame members and pouches are affixed to the sides of the portable seat. Various handles and straps are also attached to the sides of the portable seat to facilitate transport.

8 Claims, 4 Drawing Sheets

FIG.5
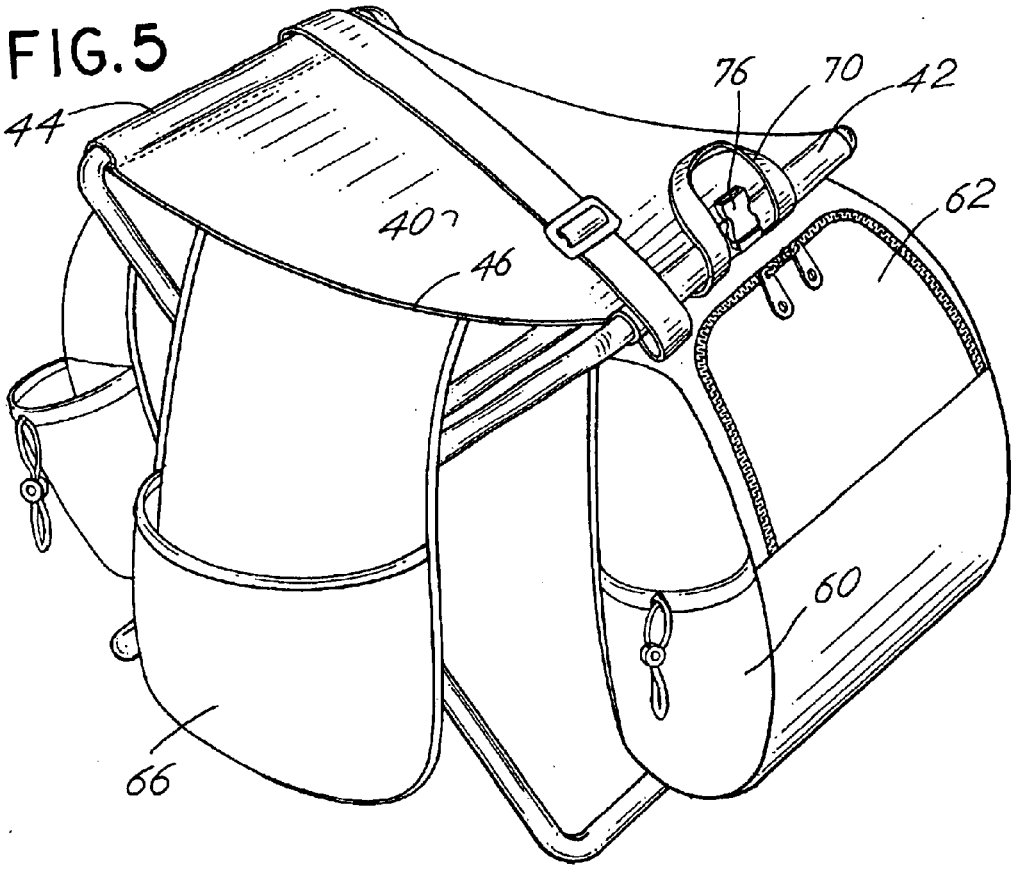
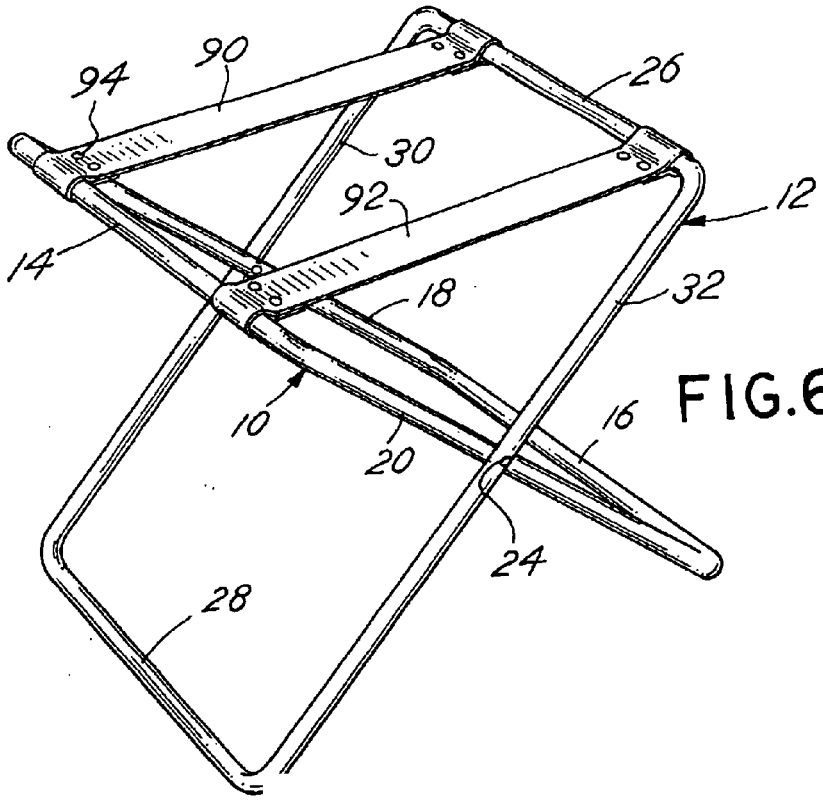
FIG.6

COLLAPSIBLE PORTABLE SEAT CONSTRUCTION

BACKGROUND OF THE INVENTION

In a principal aspect the present invention relates to a portable and foldable seat which may be folded for transport and carrying to a sporting event, for example, and which may be unfolded to support an individual in a sitting position.

When attending a sporting event, engaging in outdoor activates, such as picnicking, fishing, hunting or the like, it is often desirable to have a seat upon which the individual may be seated during the outdoor activity. Various types of folding seats have been available. For example, fabric seats affixed to folding frames are known. Additionally, a folding seat device attached to the top of a post or pole is known. The folding seat sections may be unfolded to provide a support seat on the post.

While such prior art seats are very useful, there has remained a need for an improved portable seat which can be easily transported and which may also serve an additional purpose; namely, carrying of materials such as fishing gear, picnic gear or hunting gear. Such needs inspired the development of the present invention.

SUMMARY OF THE INVENTION

Briefly, the present invention comprises a seat construction which is portable and which is comprised of first and second tubular, rectangular frames. The frames are connected at the midpoints of their lateral sides so that they may be folded between an opened position and a closed position. A fabric seat panel in a desired shape or configuration is attached to and suspended between the top legs of the frame members so that the fabric may be folded when the frames are folded to the closed position. The outer ends of the fabric panel forming the seat include pouches affixed thereto which are suspended downwardly from the top of each frame member. A further pouch is attached to the center portion of the seat panel to provide for storage. The rigid frame members may be easily folded and retained in the folded position by means of a latch member. A support strap enables the folded seat to be easily carried, along with the pouches affixed to the seat panel.

Thus, it is an object of the invention to provide an improved portable folding seat construction which is rugged, easy to fold between an opened and closed position, and easily transportable.

It is a further object of the invention to provide an improved portable seat construction which includes storage pouches incorporated with the seat.

Yet another object of the invention is to provide an inexpensive, yet exceptionally rugged and utilitarian portable seat.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 5 is an isometric view of the seat of FIG. 1 as viewed from the opposite side of the seat when in the open position; and FIG. 6 is an isometric view of an alternative construction of the tubular frame member.

DESCRIPTION OF THE PREFERRED EMBODIMENT

Figure 2:
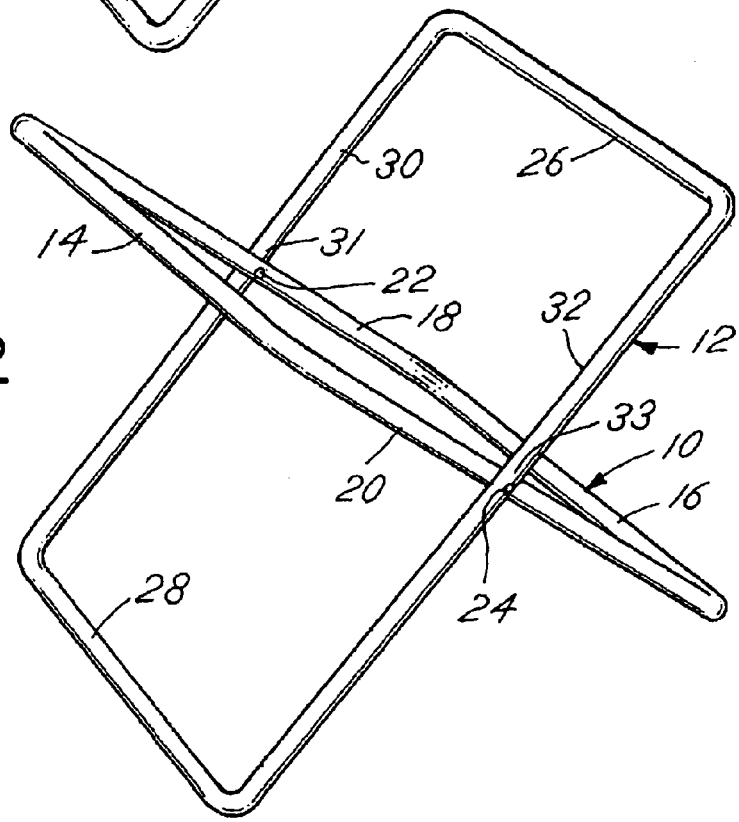
FIG. 2 is an isometric view of the tubular frame members utilized in the portable seat construction of FIG. 1.

The collapsible portable seat construction of the present invention is comprised of three basic elements. A first rigid rectangular frame member 10, as depicted in FIG. 2, is attached to a second rigid, rectangular frame member 12, again, as illustrated in FIG. 2. The first frame member includes a top leg 14, a bottom leg 16, a first lateral or side leg 18, and a second lateral or side leg 20. The top leg 14 is parallel to and spaced from the bottom leg 16. The distance from side to side between the lateral or side legs 18 and 20 is constant. The first frame member 10 includes a midpoint connection 22 in the lateral side leg 20 and a midpoint connection 24 in the lateral side leg 20. The connection points 22 and 24 facilitate pivotal connection of the frame member 10 to the frame member 12.

Figure 4:
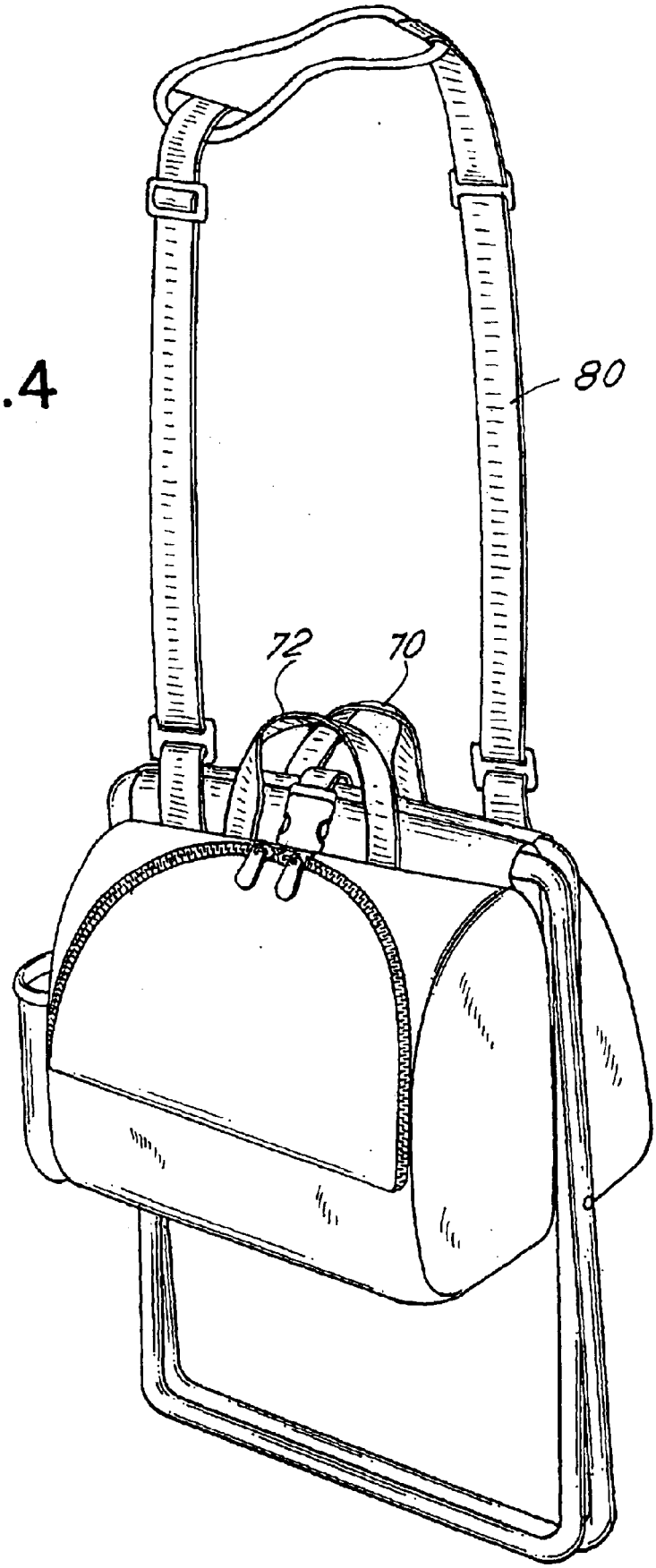
FIG. 4 is an isometric view of the seat construction of FIG. 1 wherein the seat has been folded to the closed position.

The frame member 12 similarly includes an upper or top leg 26 and a bottom or lower leg 28 parallel to the upper leg 26. Frame member 12 further includes a lateral or first side leg 30 parallel to and spaced a lateral or second side leg 32. The length of the top leg 26 and bottom leg 28 is equal and defines the constant distance between the side legs 30 and 32. The side legs 30 and 32 are spaced approximately 12–13 inches apart whereas the side legs 18 and 20 of the first frame member 10 are spaced approximately 11–12 inches apart. This enables the frame member 10 to fit within the second frame member 12 when the frames 10, 12 are folded. Second frame member 12, side legs 30, 32 also include midpoints 31, 33 for pivotal connection at midpoints 22, 24 of legs 18, 20 of first frame 10. Thus, the frame members 10 and 12 are connected at the midpoint connections 22, 31 and 24, 33 so that the frame members may be folded between and opened position as illustrated in FIG. 2 to a closed position as illustrated in FIG. 4.

The side legs 18, 20 of first frame member 10 are equal in length to the length of second frame 12 side legs 30, 32. Thus, the seat when unfolded (as described herein) will be horizontal or level.

Figure 1:
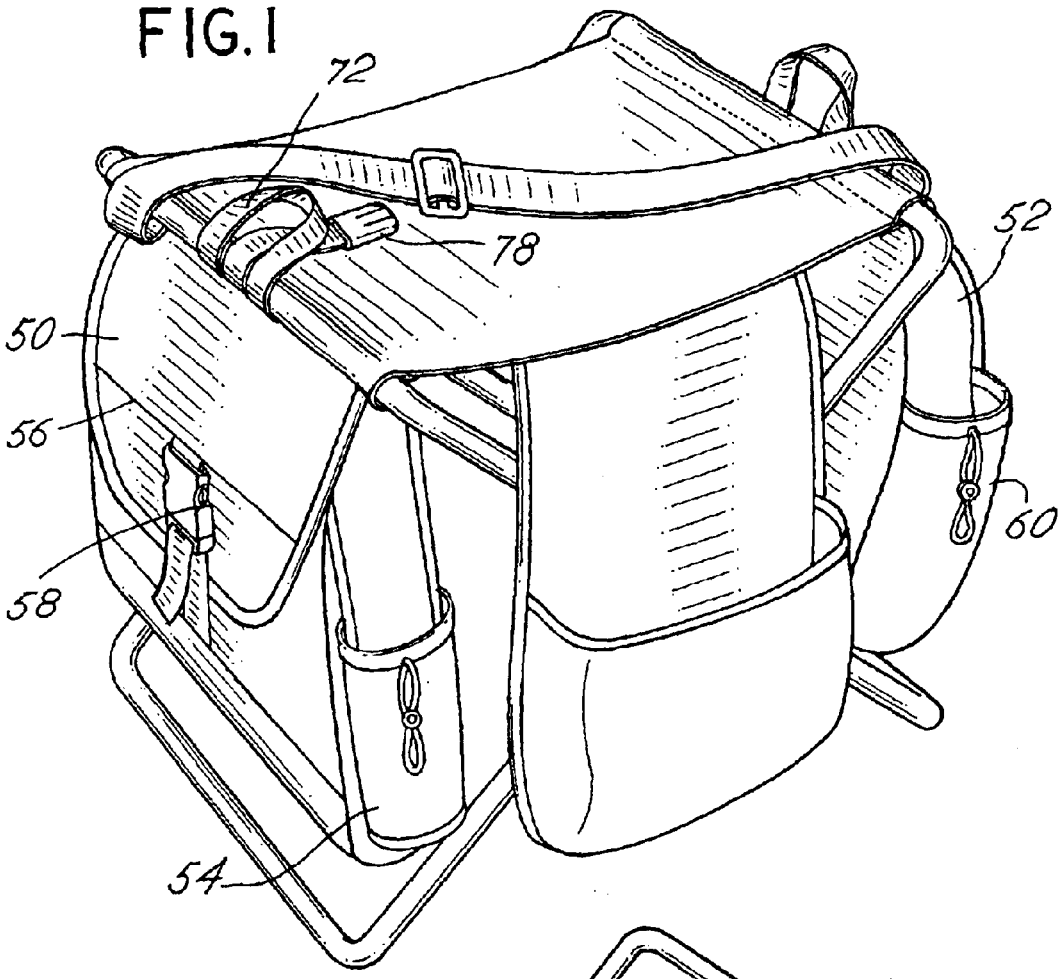
FIG. 1 is an isometric view of the portable scat construction in the open position.
Figure 3:
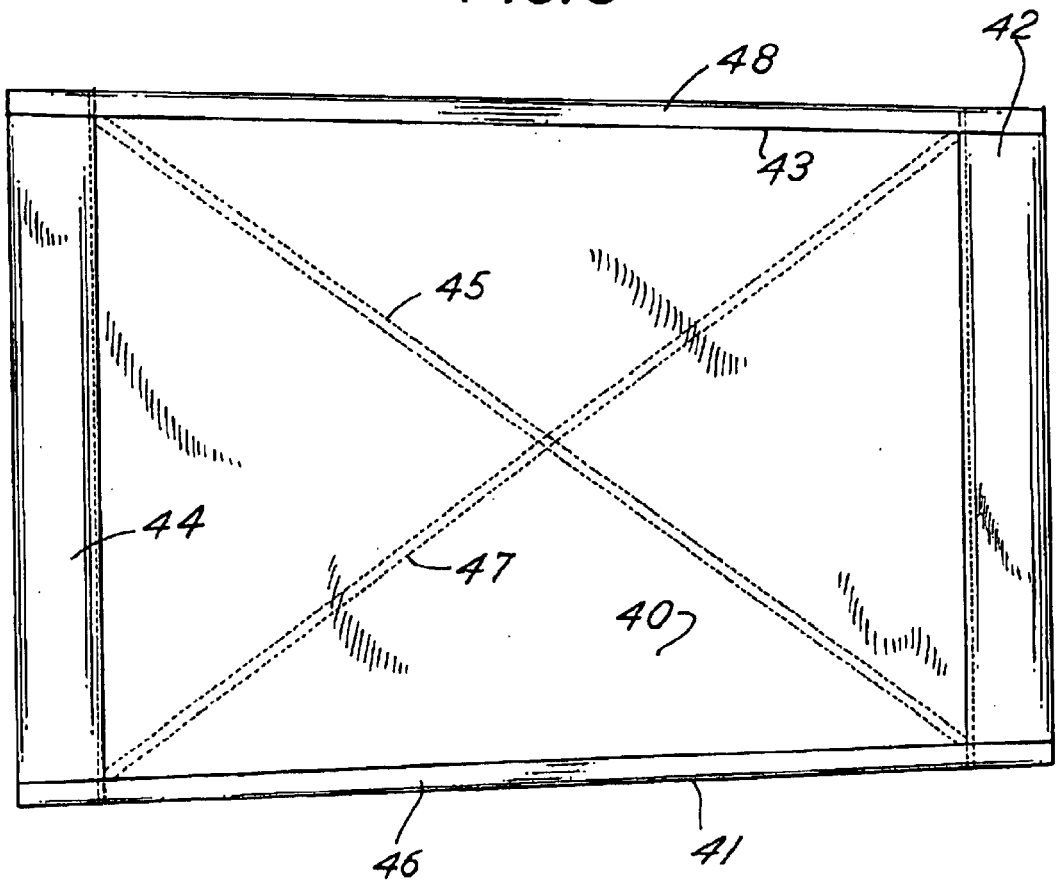
FIG. 3 is a plan view of the fabric which comprises the seat panel that is affixed to the frame members of FIG. 2.

Attached to the respective top leg 14 of first frame member 10 and top leg 26 of second frame member 12 is a flexible fabric seat section 40 as depicted in the top plan view of FIG. 3. The scat section 40 has a trapezoidal shape with a first parallel side loop 42 parallel to a second side loop 44. The edges or sides 41, 43 of seat panel 40 include a stitched binding or seam 46, 48, respectively. Sides 41, 43 converge from the first loop 44 to the second loop 42. The first loop 42 is sewn or fitted around the top leg 14 of the first frame member 10 in FIG. 2. The second or laterally (side to side) wider loop 44 is fitted around and sewn around the top leg 26 of the second frame member 12. When in the opened position as illustrated in FIG. 1, the loops 42 and 44 will fit across the entire distance or space between the side legs of the appropriate frame member 10 or 12. The material utilized to make the flexible seat 40 may be a canvas material, plastic material, or some other flexible fabric material.

To provide additional structural integrity for the seat panel 40, additional binding or strips of material 45, 47 may be sewn in a crossing pattern between loops 42, 44 as depicted in phantom in FIG. 3. Various reinforcing patterns may be adopted. FIG. 6 illustrates an alternative construction which also provides for enhancing the structural integrity of a seat panel mounted on the frame members 10 and 12. In particular, parallel straps 90 and 92 are attached over the top legs 14 and 26 and connect the top legs 14, 26 of the frame members 10 and 12. The straps 90 and 92 are generally parallel, spaced laterally one from the other, of equal length and dimension, and retained on the legs 14 and 26 by being folded over the legs 14 and 26 and stitched or attached by rivets, such as rivet 94 in FIG. 6. The seat panel 40 may then be fitted over the top legs 14 and 26 to complete the assembly.

An important additional feature of the portable seat of the invention is the inclusion of a first pouch 50 constituting an extension of the lateral side loop 44 of the seat panel 40 and a second pouch 52 constituting an extension of and attachment to the opposite loop 42 of the seat panel 40. This is depicted in FIGS. 1 and 5. The pouch 50 may be formed from a separate flexible material to provide a container for various items positioned along a lateral side of the seat construction. For example, the pouch 50 may include a supplemental bottle container or pouch 54. It may further include a closure flap 56 with a latch member 58. Similarly, the pouch 52 may include a bottle container or pouch 60 and a zippered closure flap 62 as depicted in FIG. 5. In either event, access to the pouches 50 and 52 may be enjoyed by a person sitting on the seat panel 40 when the seat is in the open position merely by opening the flap 56 or 62.

A further medial pouch 66 may be affixed to a side, for example, side 46 of the seat 40 as depicted, for example, in FIG. 5. The pouch 66 may thus be suspended between the legs of a user of the portable seat or along the back side for easy access and use by the user of the seat construction.

Another feature of the invention is the utilization of handle straps, such as handle straps 70 and 72 in FIGS. 1 and 5. The handle straps 70 and 72 are attached respectively at or near the loops 42 and 44 and may be gripped to retain the seat in the folded condition such as depicted in FIG. 4. Further, a buckle or clasp 76 in FIG. 5 may be joined with a buckle or clasp 78 in FIG. 1 to hold the portable seat in the closed position, again as depicted in FIG. 4. Further, an arm strap or shoulder strap 80 may extend between loop 42 and loop 44 as depicted in FIGS. 1 and 5. This further facilitates ease of carrying of the portable seat.

The portable seat may thus be easily folded between an opened position as illustrated in FIGS. 1 and 5, to a closed position as illustrated in FIG. 4, and retained in the closed position by gripping the handle straps 70 and 72 by engagement of the clasp members 76 and 78 or by the shoulder strap 80. Consequently, three modes of maintaining the portable seat in the closed position are possible. Additionally, because of the incorporation of the pouches 50 and 52 with the portable seat construction, it is possible to carry various items associated with the event which is being attended. For example, fishing gear may be included in the pouches. Picnic items may be included in the pouches. Thus, the portable seat of the invention has a multiplicity of uses and may be easily utilized, not only as a seat, but to carry various items associated with the event for which the seat is being used.

Various alternative constructions may be adopted without departing from the spirit and scope of the invention. For example, the number, shape and configuration of the pouches may be varied. The construction of the hand strap and shoulder strap may be varied. Thus, the invention is to be limited only by the following claims and equivalents thereof.

What is claimed is:

1. A collapsible sport seat comprising, in combination:

a first tubular frame member in the form of a rectangle having generally parallel side legs, a top leg and a bottom leg generally parallel to the top leg, said side legs having a generally middle connection point;

a second tubular frame member in the form of a rectangle with generally parallel, spaced side legs, a top leg and a bottom leg, said second tubular frame member top leg and bottom leg generally parallel, said side legs of said second tubular frame member having a generally middle connection point;

said side legs of said first frame member being spaced apart by a first inside dimension; said side legs of said second frame member having an outside dimension substantially equal to the first inside dimension, said side legs of each frame member being substantially equal in length;

said first tubular frame member side legs each pivotally joined to a side leg of the second tubular frame member at the middle connection points;

said side legs of the second tubular frame members fitted within the first tubular frame member; and a flexible fabric seat panel having first and second, spaced attachment loops, attached respectively to the top leg of the first and second frame members; said fabric seat panel having a generally regular trapezoidal plan view configuration comprised of generally parallel first and second spaced loop sides, wherein the first loop side has a lesser dimension than the second loop side and is attached to the top leg of the second frame member; and wherein the second loop side is attached to the top leg of the first frame member.

2. The sport seat of claim 1 wherein the seat panel includes at least one panel fabric extension from at least one loop.

3. The sport seat of claim 1 wherein the seat panel includes a first panel fabric extension from the first loop and a second panel fabric extension from the second loop each extension comprising a storage pouch.

4. The sport seat of claim 1 further including a carry strap extending between the first and second loops.

5. The sport seat of claim 1, 2, 3 or 4 further including an auxiliary flexible fabric pouch attached to and suspended from the seat panel intermediate the loops.

6. The sport seat of claim 1, 2, 3 or 4 further including an attachment clip member attached to each loop, said clip members connectable to retain the seat in a closed position with the frame members pivoted together with the top legs thereof arrayed side by side.

7. The sport seat of claims 1, 2, 3 or 4 further including at least one auxiliary strap connecting the top legs of the first and second tubular frame members.

8. The sport seat of claim 1 further including binding reinforcement strips connected between the loops.

* * * * *